US008763966B2

(12) United States Patent
Stupnik et al.

(10) Patent No.: US 8,763,966 B2
(45) Date of Patent: Jul. 1, 2014

(54) DEVICE FOR FASTENING THE HOUSING OF A REFRIGERANT COMPRESSOR

(75) Inventors: Axel Stupnik, Graz (AT); Markus Spörk, Feldbach (AT); Markus Pucher, Puch Bei Weiz (AT); Peter Schöllauf, Hatzendorf (AT); Reinhard Resch, Feldbach (AT)

(73) Assignee: Secop Austria GmbH (AT)

( * ) Notice: Subject to any disclaimer, the term of this patent is extended or adjusted under 35 U.S.C. 154(b) by 524 days.

(21) Appl. No.: 12/919,892

(22) PCT Filed: Feb. 27, 2009

(86) PCT No.: PCT/EP2009/052359

§ 371 (c)(1),
(2), (4) Date: Jan. 31, 2011

(87) PCT Pub. No.: WO2009/106608

PCT Pub. Date: Sep. 3, 2009

(65) Prior Publication Data

US 2011/0114818 A1 May 19, 2011

(30) Foreign Application Priority Data

Feb. 27, 2008 (AT) ..... GM 120/2008 U

(51) Int. Cl.
*A47B 96/00* (2006.01)

(52) U.S. Cl.
USPC ..... 248/221.11; 248/223.41; 248/677

(58) Field of Classification Search
USPC ..... 248/220.21, 220.22, 221.11, 222.11, 248/222.12, 222.14, 223.41, 223.21, 248/225.11, 346.06, 221.12, 222.41, 677, 248/188.8, 188.9; 403/331, 360, 381, 245, 403/246, 253, 254
See application file for complete search history.

(56) References Cited

U.S. PATENT DOCUMENTS 1,730,698 A * 10/1929 Wagner, Jr. ..... 248/346.11
3,282,519 A * 11/1966 Rheinstrom ..... 242/596.8

(Continued)

FOREIGN PATENT DOCUMENTS

DE 32 42 858 A1 3/1984
DE 295 07 374 U1 7/1995

(Continued)

OTHER PUBLICATIONS

International Search Report, PCT/EP2009/052359, ACC Austria GMBH, Mailed Oct. 20, 2009.

*Primary Examiner* — Alfred J Wujciak
(74) *Attorney, Agent, or Firm* — McKee, Voorhees & Sease, P.L.C.

(57) ABSTRACT

A device for fastening the housing (2) of a refrigerant compressor at a container enclosing a cooling volume, wherein the housing (2) can be fastened to a support element (1) located at the container by way of an arbitrary number of connecting elements (3), wherein at least one connecting element (3) is provided that can be fixed in clamped or latched fashion in at least one corresponding receptacle (4), wherein the at least one connection element (3) and the at least one receptacle (4) can be located either at the housing (2) or at the support element (1). In order to facilitate a simple, fast and nevertheless reliable fastening of the refrigerant compressor at the support element (1), it is provided according to the invention that the housing (2) can be moved from a first mounting position in which the at least one connection element (3) is laid into the at least one receptacle (4) to an operating position in which the connection element (3) is fixed in the receptacle (4) in clamped or latched fashion.

5 Claims, 7 Drawing Sheets

(56) References Cited

U.S. PATENT DOCUMENTS

| | | | | |
|---|---|---|---|---|
| 4,470,716 | A * | 9/1984 | Welch | 403/254 |
| 4,633,789 | A * | 1/1987 | Kortering et al. | 108/152 |
| 5,167,478 | A * | 12/1992 | Ramunas | 409/234 |
| 5,601,272 | A * | 2/1997 | Adams et al. | 248/518 |
| 5,624,098 | A * | 4/1997 | McDowell | 248/550 |
| 5,749,550 | A * | 5/1998 | Jackson | 248/188.2 |
| 6,109,819 | A * | 8/2000 | Welch | 403/353 |
| 6,378,825 | B1 * | 4/2002 | Yee et al. | 248/221.11 |
| 7,685,846 | B2 * | 3/2010 | Hwang et al. | 68/3 R |
| 2005/0260033 | A1 * | 11/2005 | Arbona et al. | 403/381 |

FOREIGN PATENT DOCUMENTS

| | | | |
|---|---|---|---|
| DE | 299 05 758 | U1 | 8/2000 |
| EP | 0 402 577 | A1 | 12/1990 |
| KR | 20010066577 | A | 7/2001 |
| WO | WO 00/46504 | A1 | 8/2000 |
| WO | WO 2006/092387 | A1 | 9/2006 |
| WO | WO 2007/122235 | A1 | 11/2007 |

* cited by examiner

Detail B

DEVICE FOR FASTENING THE HOUSING OF A REFRIGERANT COMPRESSOR

CROSS-REFERENCE TO RELATED APPLICATIONS

This application claims priority to PCT/EP2009/052359 filed Feb. 27, 2009, which claims priority to AT GM 120/2008 filed Feb. 27, 2008, herein incorporated by reference in their entirety.

FIELD OF THE INVENTION

1. Prior Art

The invention relates to a device for fastening the housing of a refrigerant compressor on a container enclosing a cooling volume, wherein the housing can be fastened by means of an arbitrary number of connection elements on a carrier element arranged on the container, wherein the at least one connection element or the at least one receptacle can be arranged selectively on the housing or on the carrier element according to the preamble of claim 1.

Such refrigerant compressors have been known for a long time and are used predominantly in refrigerators and cooler cabinets for private and commercial use.

In the course of the refrigerant process, a refrigerant is heated in an evaporator in a known way by the absorption of energy from the space to be cooled and finally superheated and pumped by means of the refrigerant compressor to a higher pressure level, where it outputs heat via a condenser and feeds it back into the evaporator via a throttle in which the pressure is reduced and the refrigerant is cooled.

For this purpose, the refrigerant compressor has a hermetically sealed housing in whose interior a piston-cylinder-motor arrangement operates that compresses the refrigerant and shall be designated in context below, for the sake of simplicity, as a working unit. The housing holding the working unit is consequently positioned on a carrier element provided for this purpose and connected to the cooling system or to evaporator and condenser lines of a refrigerator or cooling device.

The carrier element usually has a plate-shaped construction and offers a contact area for the housing of the refrigerant compressor. Such carrier elements are typically arranged in the area of the base or the back wall of a container enclosing a cooling volume or of the cooling device.

For fastening the housing on the carrier element, a connection element is used that is typically constructed as a screw connection. For example, arrangements are known in the prior art in which angle profiles welded on the housing are screwed tight on the carrier element by means of screw bolts. The distances of the connection elements or the distances of corresponding receptacles provided on the carrier element are fixed by appropriate standards.

The mounting of such screw connections, however, is time-intensive and often associated with considerable difficulties—due to special housing and carrier-element geometries. The use of various mounting tools required here and a plurality of components produces relatively high assembly complexity and costs. Also, the refrigerant-compressor housing can often be disassembled from the cooling device or from the carrier element only by damaging the cooling device or the refrigerant-compressor housing, because the screw connection has rusted in place.

In addition to screw connections, adhesive connections for fastening the refrigerant-compressor housing on the carrier element are also known. Here, disassembly that is easy on the components is also rarely possible.

Clamping connections are also known, for example, from WO 2006/092387 A1. The production of the clamping connections, however, is associated with high assembly costs, as is the disassembly, in the case of known refrigerant compressors.

DE 299 05 758 U1 shows a compressor foot plate that is fixed by means of additional clamp elements 27, wherein, however, no additional fastening of the compressor housing is performed. EP 402 577 A1 shows a latching connection between a compressor housing and a carrier element that can be screwed with a cooling container.

2. Description of the Invention

Therefore, the task of the present invention is to make possible a simplified and reliable fastening of the refrigerant-compressor housing on the corresponding carrier element.

In particular, mounting the refrigerant-compressor housing on the carrier element should be possible with low costs in terms of assembly, components, and time.

In addition, fastening the refrigerant-compressor housing on the carrier element should be reversible and should be easy to detach when needed.

These tasks are achieved by a device according to the characterizing features of claim 1.

According to claim 1, a device for fastening the housing of a refrigerant compressor on a container enclosing a cooling volume comprises an arbitrary number of connection elements by means of which the housing can be fastened on a carrier element arranged on the container, wherein at least one connection element is provided that can be fastened in a clamping or latching manner in at least one corresponding receptacle, wherein the at least one connection element or the at least one receptacle can be arranged selectively on the housing or on the carrier element.

According to the invention, the housing can be moved from a first mounting position in which the at least one connection element is threaded into the at least one receptacle to an operating position in which the connection element is fastened in the receptacle in a clamped or latched manner, wherein the receptacle has a first receptacle section in which the connection element can be threaded into the receptacle and a second receptacle section in which the connection element is latched or clamped, and the carrier element has a retaining lip that constructs the second receptacle section and is elevated relative to a top side of the carrier element pointing toward the housing, wherein the foot section of the connection element can slide with an end facing away from the housing on the top side of the carrier element and can be moved into the retaining lip.

In this way, through the use of clamping or latching techniques, not only does the use of screws become obsolete and therefore the mounting expense can be significantly simplified relative to fastening by means of screws, but also, relative to conventional clamping and latching techniques, an especially simple fastening of the housing on the carrier element is made possible.

In one construction of the invention that is especially preferred because it is economical in terms of material, the at least one receptacle is arranged on the carrier element, while the at least one connection element is arranged on the housing.

Fastening the housing on the carrier element is reversible, according to the invention, so that, when needed, the housing can be disassembled easily and quickly.

The connection element can be fastened in the receptacle both by means of a linear movement, that is, on a linear path, or also by means of a rotational movement, that is, on a rotating or circular-arc-shaped path.

The selection of whether the connection element(s) is to be fixed in its/their end position by a linear or translated or rotated movement can be made as a function of the present geometry of the housing and the carrier element or the cooling device.

In particular, a rotated fixing of the connection element(s) in the corresponding receptacle(s) ensures a stable and vibration-resistant holding of the housing on the carrier element. A short and effective mounting movement is made possible because the housing can be transferred by means of a rotational movement from the mounting position into the operating position.

In one especially preferred construction of the invention, the receptacle has a first receptacle section in which it is possible to thread the connection element into the receptacle and a second receptacle section in which the connection element is latched or clamped. The open width of the first receptacle section is preferably greater than the open width of the second receptacle section. This makes possible an exact arrangement and a precise guide of the connection element in the receptacle.

In one special variant of the invention, the open width of the receptacle is decreased in a linear fashion between the first receptacle section and the second receptacle section. In this way, a receptacle is produced that is suitable for clamping the connection element.

In another special variant of the invention, it is provided that the open width of the receptacle is first decreased and then expanded in the transition from the first receptacle section to the second receptacle section. In this way, a receptacle is produced that is suitable for latching the connection element.

In one advantageous variant of the invention with respect to production, each receptacle is made from two overlapping, circular openings.

In one especially preferred variant, the connection element has a shaft section that can be held in the receptacle sections of the receptacle and a foot section adjacent to this shaft section. The foot section is located farther from the housing than the shaft section. Here, the open width of the first receptacle section is greater than the greatest cross-sectional width of the foot section (and thus allows the foot section to be held without a problem or to be passed through the first receptacle section), while the open width of the second receptacle is less than the greatest cross-sectional width of the foot section.

Such a construction of the connection device allows a simple insertion of the connection element in the first receptacle section of the receptacle, wherein the connection element can be consequently fed by means of a linear or rotating movement into an end position in the second receptacle section corresponding to the operating positions of the housing. Because the greatest cross-sectional width of the foot section is greater than the open width of the second receptacle section, when this end position is reached, it is no longer possible to raise the housing from the carrier element and the housing is fastened on the carrier element.

With respect to the dimensioning of the shaft section passing through the receptacle, there are several possibilities.

In a first variant, it is provided that the greatest cross-sectional width of the shaft section is dimensioned smaller than the open width of the second receptacle section. In such constructions, there is play between the lateral surface of the shaft section and the boundary of the second receptacle section, and the shaft section or the connection element can be moved within the receptacle easily.

Alternatively, the greatest cross-sectional width of the shaft section can indeed be constructed smaller than the open width of the first width of the first receptacle section (in which the shaft section or the connection element is inserted for the first mounting position of the housing), but the greatest cross-sectional width of the shaft section is greater by a first dimension of fit than the open width of the second receptacle section. Thus, if the connection element is fed according to this configuration into its end position in the second receptacle section, then a press fit is realized between the second receptacle section and the shaft section of the connection element. In this way, unintentional movement of the connection element back into its starting position against the mounting direction is prevented. In particular, in this way it can be prevented that the connection element is detached from its fixed end position due to vibrations of the refrigerant compressor caused by operation.

An especially reliable fastening of the connection element in its end position is made possible because at least the shaft section of the connection element is made in a preferred variant from a material that can be deformed elastically or plastically. Compression of the shaft section that can be deformed elastically or plastically during its movement into the end position secures the connection element against movement back into its starting position.

Another improvement of the connection device according to the invention is made possible in that the receptacle has a third receptacle section arranged between the first receptacle section and the second receptacle section, wherein the open width of this third section is less than the open width of the second receptacle section and wherein the open width of the third receptacle section is smaller additionally by a second dimension of fit than the greatest cross-sectional width of the shaft section. The connection element can be locked securely in its end position or in the operating position of the housing because, between the first and second receptacle section there is a waist-forming passage in the form of the third receptacle section that the shaft section must pass during its movement into the end position.

In one especially preferred variant of the invention, the first receptacle section and the second receptacle section are constructed in the form of two keyhole-shaped passage boreholes in the carrier element merging with each other, i.e., merging with each other in the area of a peripheral segment. A receptacle constructed in this way is easy to produce with respect to production and allows an exact fastening of the connection element on the carrier element.

In another advantageous variant of the invention with respect to production, the shaft section and the foot section of the connection element are produced as separate components, wherein the shaft section has a passage opening through which an advantageously bolt-shaped adapter section of the foot section that can be fastened on the housing is guided.

In another preferred variant of the invention, the shaft section has a spacer section that is arranged, in the operating position of the housing, between the housing and the carrier element, wherein the greatest cross-sectional width of the spacer section is both greater than the open width of the first receptacle section and also greater than the open width of the second receptacle section. In particular, if this spacer section is made from a vibration-damping material, a transmission of vibrations from the housing to the carrier element can be prevented or at least damped.

To achieve additional securing of the connection device according to the invention with respect to undesired detachment, it is provided in a preferred variant that a distance measured between the spacer section and the foot section is less by a third dimension of fit [than] the thickness of the area of the carrier element having the receptacle sections.

As already mentioned, the connection element can be fastened in the receptacle both by means of a linear movement and also by means of a rotational movement. In the latter case, the movement path of the connection element does not necessarily have a circular-arc shape, but could also have an arbitrarily curved, e.g., parabolic shape that can make possible, according to the application, a simpler or more flexible mounting.

In another preferred variant of the invention, there are at least two, advantageously three receptacles together with corresponding connection elements. The provision of at least two receptacles or connection elements makes possible a very stable fastening of the housing on the carrier element. In particular, with the provision of three receptacles or connection elements, a fastening probability is offered that is especially balanced with respect to its static determinacy.

In one special variant of the invention, the receptacles are arranged on the carrier element offset along a reference circle, advantageously offset equidistant to each other. This makes possible a simple mounting and also balanced weight distribution of the housing on the carrier element.

In the case of a construction with a retaining lip, in one refinement of the invention it is provided that the carrier element has a spring section that can be forced, during a movement of the connection element foot section, from an unloaded position into a retained position in which the connection element is fastened in the receptacle. Through the provision of such a spring section, an undesired detachment of the connection element from its end position (in which the housing is fastened in the operating position) is reliably prevented.

In one especially preferred embodiment, it is provided that the spring section is raised in its unloaded position above the top side of the carrier element and contacts the end face of the connection element foot section at least in some sections in its retained position. Due to the pressure of the spring section on the foot section, which is thus held between the retaining lip and the spring section in a clamped fashion, undesired detachment of the connection element from its end position (in which the housing is fastened in the operating position) can be prevented.

In one variant that is especially simple to realize with respect to production, the spring section is constructed in the form of a web that is constructed integrally with the carrier element and that is advantageously bent in the direction of the housing to be fastened on the carrier element.

BRIEF DESCRIPTION OF THE FIGURES

The invention will now be explained in detail with reference to an embodiment. Shown are.

MEANS FOR REALIZING THE INVENTION

Figure 1:
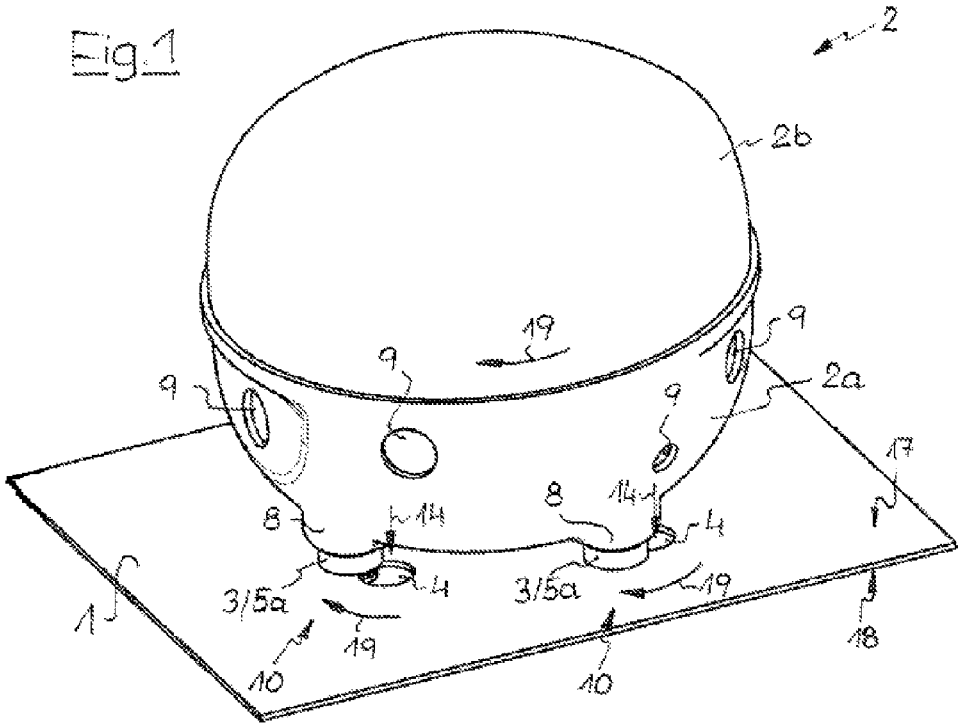
FIG. 1 a schematic diagram of a refrigerant-compressor housing fastened according to the invention on a carrier element in a perspective view FIG. 2 a top view of a carrier element according to the invention FIG. 3 a detail "B" from FIG. 2

FIG. 1 shows a refrigerant compressor with a hermetically sealed housing 2 that is fastened in the way according to the invention on a carrier element 1.

The carrier element 1 shaped like a plate in the present embodiment is part of a cooling device or a container enclosing a cooling volume and is arranged, e.g., in the area of its base or rear wall. The carrier element 1 has a top side 17 pointing toward the housing 2 and also a bottom side 18 facing away from the housing 2.

In the present embodiment, the housing 2 has a two-part construction and comprises a lower housing half 2*a* and also an upper housing half 2*b*. In the interior 7 of the housing 2, there is a working unit in the form of a piston-cylinder unit that is driven by means of an electric motor and compresses a refrigerant transported via feed and discharge lines in a known way. For receiving the feed and discharge lines, the housing 2 has various openings 9. Because the components arranged in the interior 7 of the housing 2 and their attachment to the feed and discharge lines leading to an evaporator and a condenser of the cooling device are not relevant for the understanding of the present invention, their description was eliminated.

The housing 2 can be fastened on the carrier element 1 by means of a connection device 10 according to the invention that comprises at least one connection element 3 that is arranged on the housing 2 and can be fastened in a clamped or latched manner in at least one corresponding receptacle 4 provided on the carrier element 1.

Alternatively, it would also be possible to arrange the at least one connection element 3 on the carrier element 1 of the cooling device and the at least one receptacle 4 on the housing 2, e.g., in that a plate having the receptacles 4 is fastened on the housing 2 (not shown).

According to the present embodiment, the carrier element 1 has at least three receptacles 4, while the housing 2 is provided with three corresponding connection elements 3 that can be inserted into the receptacles 4.

It would also be possible, however, to provide a different number of receptacles 4 or connection elements 3, e.g., two or four receptacles 4/connection elements 3. The provision of only one receptacle 4 as well as one connection element 3 arranged, e.g., centrally on the base of the lower housing part 2*a* would also be conceivable.

Figure 2:
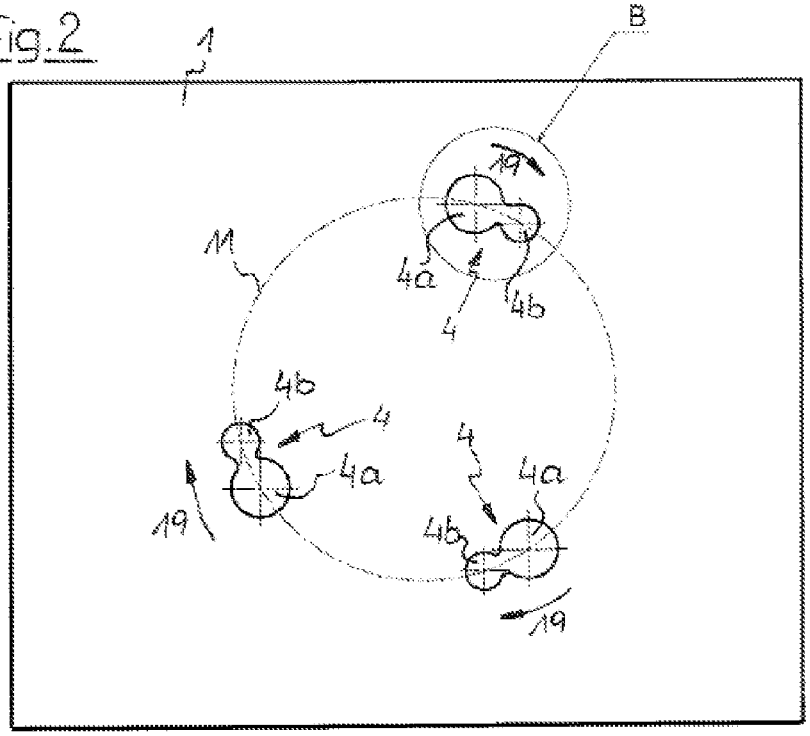

As is clear in an individual representation of the carrier element 1 according to the invention from FIG. 2, the receptacles 4 are arranged offset along a reference circle 11. The receptacles 4 are here each offset by 120° to each other, so that an equidistant arrangement of the receptacles 4 to each other is produced.

Corresponding to the position of the receptacles 4 on the carrier element 1, the connection elements 3 are arranged on the housing 2. The connection elements 3 are also arranged offset equidistant to each other along a (not shown) reference circle.

Figure 3:
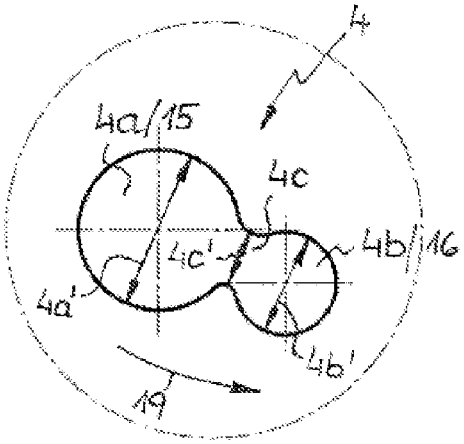

In FIG. 3, a detailed representation of a receptacle 4 is clear that is constructed in the form of two passage boreholes 15, 16 of different sizes through the carrier element 1. The centers of the boreholes 15, 16 are each arranged on the reference circle 11, wherein the two boreholes 15, 16 merge with each other in the area of a borehole peripheral segment, so that the receptacle 4 has an essentially keyhole-shaped boundary.

The first borehole 15 corresponds to a first receptacle section 4*a* of the receptacle 4, while the second borehole 16 corresponds to a second receptacle section 4*a* [sic; 4*b*] of the receptacle 4.

In other words, the cross sections of the first receptacle section 4*a* and of the second receptacle section 4*b* are constructed in the form of two overlapping circular shapes or openings.

The receptacle sections 4*a*, 4*b* of the receptacles 4 obviously could also have a different geometric shape than that shown in the present embodiment; here it is significant only that the receptacle 4 has a first section that is suitable for receiving or for the passage of the connection element 3 arranged on the housing 2 and also a second section that is narrower relative to this first section.

According to FIG. 3, the open width 4*a*' of the first receptacle section 4*a* is greater than the open width 4*b*' of the second receptacle section 4*b*.

Figure 4:
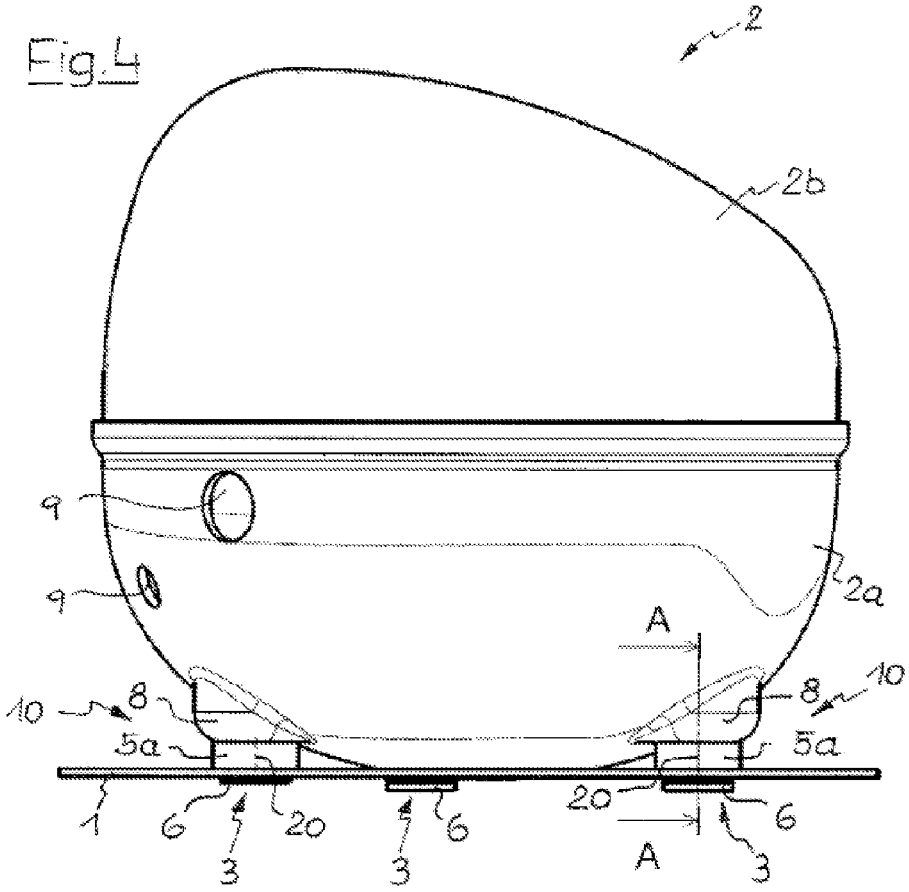
FIG. 4 a refrigerant-compressor housing fastened according to the invention on a carrier element from FIG. 1 in a side view FIG. 5 a sectional view along Line A-A in FIG. 4
Figure 5:
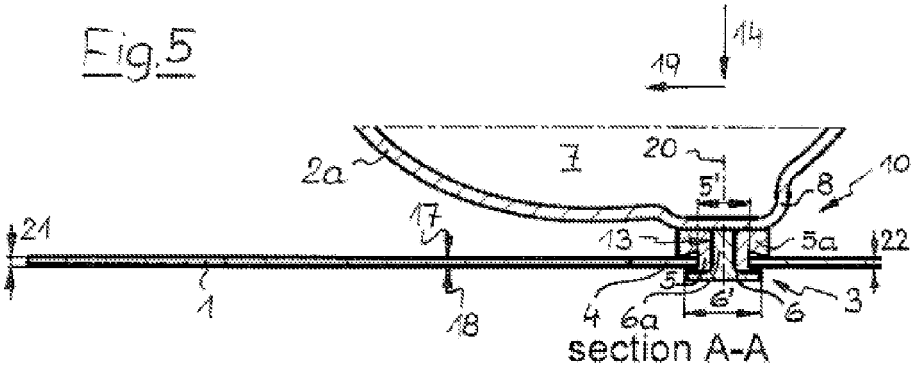

The means of fastening the connection element 3 on the carrier element 1 can be understood with regard to FIG. 5 that shows a detail of a side view of the refrigerant compressor according to FIG. 4. The lower housing half 2*a* has several bulges 8—in the present embodiment three bulges—on which the already mentioned connection elements 3 are arranged, e.g., welded or screwed. An integral construction of the connection elements 3 with the housing 2 is also possible.

The connection element 3 has a shaft section 5 bordering the housing 2 and a foot section 6 arranged in an end area of the shaft section 5 facing away from the housing 2, wherein the shaft section 5 and the foot section 6 have a cylindrical or disk-like shape.

The first receptacle section 4*a* has an open width 4*a*' shown in FIG. 3 (that corresponds in the present embodiment to the diameter of the first borehole 15) that is greater than the greatest cross-sectional width 6' or the diameter of the foot section 6 shown in FIG. 5. In this way, it is possible to receive the foot section without a problem or to guide the foot section 6 through the first receptacle section 4*a* in the way described in detail below.

In contrast, an open width 4*b*' of the second receptacle section 4*b* or the diameter of the second borehole 16 is less than the cross-section width 6' or the diameter of the foot section 6.

The greatest cross-sectional width 5' of the shaft section 5 shown in FIG. 5 is selected so that the shaft section 5 can be moved by the manual application of force without a problem both in the first receptacle section 4*a* and also in the second receptacle section 4*b*.

Independent of the actual geometric construction of the receptacle 4, the first receptacle section 4*a* should in each case allow threading of the connection element 3 into the receptacle 4.

The housing 2 is mounted on the carrier element 1 in the following way:

The housing 2 is first moved into a position in which the connection elements 3 are located above the first receptacle sections 4*a* (in the present embodiment, the longitudinal axis 20 of the connection element 3 aligns with the axis of the first borehole 15). Then the foot section 6 is threaded into the receptacle 4 in a first mounting direction 14 shown in FIG. 1 and in FIG. 5 (first mounting movement). The first mounting direction 14 here runs in the axial direction of the connection elements 3 or essentially normal to the top side 17 of the carrier element 1.

As soon as the connection elements 3 are threaded into the corresponding first receptacle sections 4*a* of the receptacles 4, the housing 2 is located in a first mounting position.

Consequently, the housing 2, together with the connection elements 3, is turned into an operating position, following a second mounting direction 19 (second mounting movement—see also FIG. 2). The second mounting direction 19 runs essentially normal to the first mounting direction 14 and essentially parallel to the top side 17 of the carrier element 1 (that is arranged horizontally in the present embodiment). The second mounting direction 19 also runs essentially normal to the longitudinal axis 20 of the connection element 3. If one looks at the arrangement shown in FIG. 1 from a bird's-eye view, a rotation of the housing 2 in the clockwise direction is performed.

Figure 6:
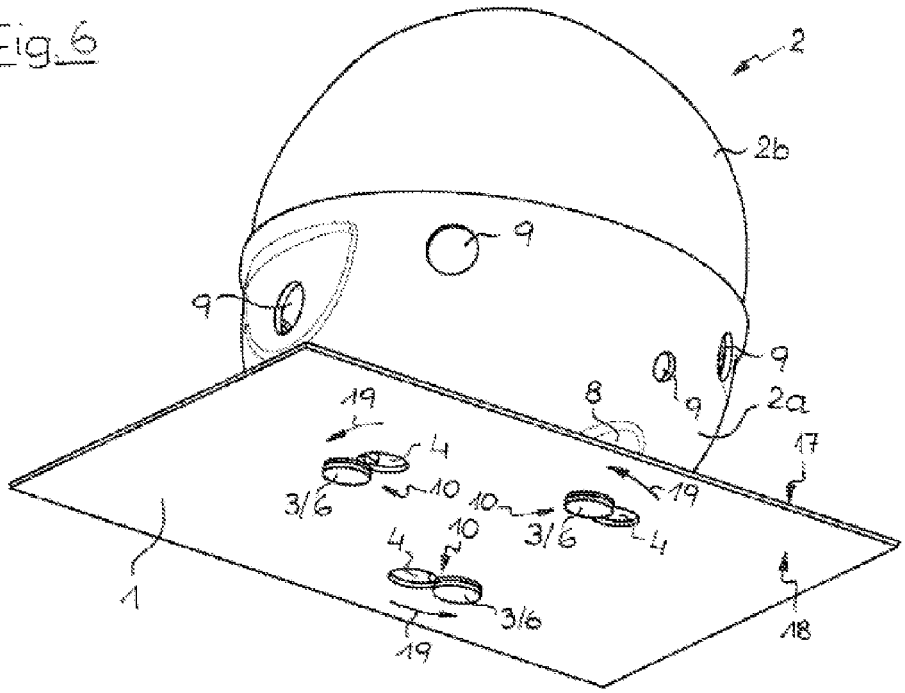
FIG. 6 the refrigerant-compressor housing fastened according to the invention on a carrier element from FIG. 1 in a bottom view FIG. 7 a top view of a carrier element according to the invention in an alternative construction FIG. 8 a refrigerant-compressor housing fastened according to the invention on a carrier element according to FIG. 7 in a side view FIG. 9 a sectional view along Line A-A in FIG. 8

During this second mounting movement, the connection elements 3 are moved from a starting position in which the longitudinal axes 20 of the connection elements 3 are located within the first receptacle section 4*a* to an end position in which the longitudinal axes 20 of the connection elements 3 are located within the second receptacle section 4*b*. When the connection elements 3 were moved into their end position, the housing 2 is also located in its operating position and is fastened in this position on the carrier element 1 (see also FIG. 6).

Because the open width 4*b*' of the second receptacle section 4*b* or the diameter of the second borehole 16 is smaller than the greatest cross-sectional width 6' or the diameter of the foot section 6, the foot section 6 that is pushed into its end position during the second mounting movement secures the housing 2 against lifting of the carrier element 1.

As is clear in FIG. 3, the receptacle 4 has a third receptacle section 4*c* that is arranged between the first receptacle section 4 and the second receptacle section 4*b* and whose open width 4*c*' is smaller than the open width 4*b*' of the second receptacle section 4*b*, wherein the open width 4*c*' of this third receptacle section 4*c* is also smaller by a second dimension of fit than the cross-sectional width 5' of the shaft section 5. As FIG. 3 shows, those areas in which the two receptacle sections 4*a* and 4*b* flow one into the other and in which the third receptacle section 4*c* is located are provided with rounded sections 12, in order to allow an ideal movement of the shaft section 5 into its end position.

During its movement from the starting position into its end position, the shaft section 5 of the connection element 3 must pass a waist-forming passage in the form of the third receptacle section 4*c*. After passage of the third receptacle section 4*c* following the second mounting direction 19, the shaft section 5 of the connection element 3 and thus the entire housing 3 is prevented from backward movement opposite the second mounting direction 19. Because the connection element 3 is from now on clamped or latched securely in its end position, an especially effective lock against backward rotation of the housing 3 into its first mounting position is achieved.

If the connection element 3 is to be moved back into its starting position or if the housing 3 is to be detached from its operating position in the course of disassembly, then a movement cycle opposite the previously described second and first mounting direction 19 and 14 must be performed.

The cross-sectional width 5' of the shaft section 5 can be constructed in different ways.

Thus, it is provided in a first variant that the (greatest) cross-sectional width 5' of the shaft section 5 is dimensioned smaller than the open width 4*b*' of the second receptacle section 4*b*. In such cases, there is play between the lateral surface of the shaft section 5 and the boundary of the second receptacle section 4*b*, and the shaft section 5 or the connection element 3 can be moved with room to move freely within the entire receptacle 4 (as long as the open width 4*c*' of the third receptacle section 4*c* is not selected smaller than the greatest cross-sectional width 5' of the shaft section 5).

Alternatively, the cross-sectional width 5' of the shaft section 5 can indeed be constructed smaller in a second variant than the open width 4*a*' of the first receptacle section 4*a*, wherein, however, the cross-sectional width 5' of the shaft section 5 is constructed larger by a first dimension of fit than the open width 4*b*' of the second receptacle section 4*b*. Thus, if the connection element 3 is moved according to the second variant into its end position in the second receptacle section 4*b*, then a press fit is realized between the second receptacle section 4*b* and the shaft section of the connection element or a significant resistance opposes the second mounting movement in the mounting direction 19. Connection element 3 [sic] According to the second variant of the connection element shaft section 5, an unintentional or vibration-caused backward movement of the connection element 3 opposite the second mounting direction 19 into its starting position is prevented.

It should be noted that the widths 4*a*', 4*b*', 4*c*' and 5' of the receptacle 4 or the connection element 3 are always measured orthogonal to the path along which the connection element 3 is guided during the second mounting movement. Also for the case that the receptacle 4 according to the invention is not constructed as a borehole or from circular sections, but instead has a different geometry, the dimensions of the opening of the receptacle 4 that are relevant are always those measured orthogonal to the second mounting direction 19.

Because the receptacle sections 4*a*, 4*b* can each have an arbitrary geometric shape or can have a continuous or discontinuous width profile along the relevant path of motion of the connection element 3, as the open width 4*a*' of the first receptacle section 4*a*, the width of the first receptacle section 4*a* is understood at which the connection element 3 can be positioned in its starting position (and the housing 3 in its first mounting position), while as the open width 4*b*' of the second receptacle section 4*b*, the width of the second receptacle section 4*b* is understood at which the connection element 3 can be positioned in its end position (and the housing 3 in its operating position). Obviously, in this context, as the cross-sectional widths of the connection element 3 and the shaft section 5, the foot section 6, and the spacer section 5*a*, respectively, the greatest cross-sectional widths of these component sections are to be understood that are guided in the receptacle sections 4*a*, 4*b* during the mounting movements.

In one preferred variant of the invention, the shaft section 5 of the connection element 3 is made from a material that can be deformed elastically or plastically. In particular, if the connection element shaft section 5 is constructed according to the described second variant and therefore is compressed during its movement into its end position in the receptacle 4 or in the second receptacle section 4*b*, then a reliable fastening of the connection element 3 in its end position and thus of the housing 2 in its operating position can be made possible. Secure fastening of the connection element 3 is guaranteed, in particular, when the shaft section 6 is made from an elastically deformable material, because such an elastic shaft section 6 is compressed temporarily during the passage of the third receptacle section 4*c* and can then relax again completely or partially to its original size in its end position in the second receptacle section 4*b*.

Obviously, the entire connection element 3, together with the foot section 6, could be made from a material that is elastically or plastically deformable.

The shaft section 5 can be produced integrally with the foot section 6 of the connection element 3. In a preferred variant according to FIG. 5, however, the shaft section 5 and the foot section 6 of the connection element 3 are produced as separate components, wherein the shaft section 5 has a passage opening 13 through which a bolt-shaped adapter section 6*a* of the foot section 6 that can be fastened on the housing 2 is guided.

In another preferred variant of the invention, the shaft section 5 of the connection element 3 is provided with a spacer section 5*a*. The spacer section 5*a*, e.g., with a cylindrical construction, contacts, with a first end face, the top side 17 of the carrier element 1, while it is arranged, with a second end face, the bulges 8 [sic], between the housing 2 and the carrier element 1 and sets these components apart from each other. Here, the greatest cross-sectional width of the spacer section 5*a* or its diameter is constructed both greater than the open width 4*a*' of the first receptacle section 4*a* and also greater than the open width 4*b*' of the second receptacle section 4*b*.

The spacer section 5*a* is advantageously produced from a vibration-damping material, e.g., from rubber or a different plastic, in order to prevent a transfer of vibrations from the housing 2 to the carrier element 1.

Obviously, the spacer section 5*a* does not have to be constructed, as shown in the present embodiment, integrally with the shaft section of the connection element 3, but instead could also be produced as a separate element.

In order to achieve further securing of the connection device 10 relative to undesired detachment, it can be provided that the distance 22 measured between a bottom side of the spacer section 5*a* pointing toward the top side 17 of the carrier element 1 and a top side of the foot section 6 pointing toward the bottom side 18 of the carrier element 1 is smaller by a third dimension of fit [than] the thickness of the area of the carrier element 1 having the receptacle sections 4*a*, 4*b*.

From the previously described geometry of the receptacles 4 according to the invention, it follows that the second mounting movement of the connection element 3 along the second mounting direction 19 involves a rotational movement (see FIGS. 2 and 3). The center of this rotational movement or circular-arc-shaped path is to be imagined at the center of the reference circle 11. The rotational path along which each of the connection elements 3 is moved thus runs from the center of the first borehole 15 or the first receptacle section 4*a* to the center of the second borehole 16 or the second receptacle section 4*b*.

Instead of a circular-arc-shaped path that the connection element 3 traverses during the second mounting movement, it would also be obviously conceivable to provide an arbitrarily curved, e.g., parabolic path or receptacle 4.

As an alternative, however, it is also possible to arrange the receptacles 4 on the carrier element 1 and the connection elements 3 on the housing 2 so that a linear path is realized for fastening the connection elements 3 in the receptacles 4 or so that the connection elements 3 can be fastened in the receptacles 4 by means of a linear mounting movement (see FIGS. 7-11).

Figure 7:
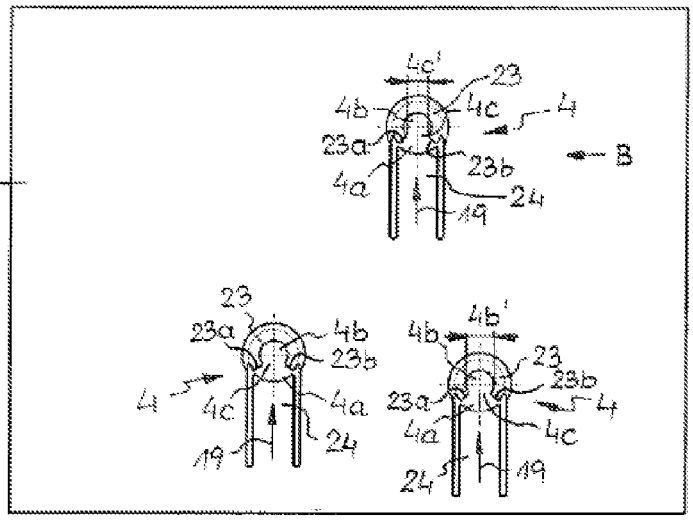
Figure 8:
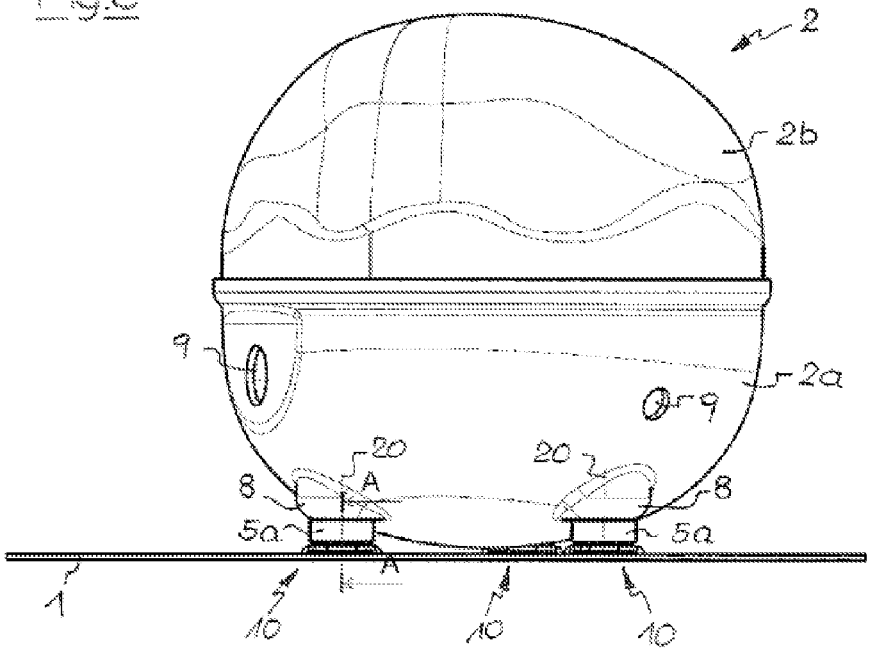

FIG. 7 here shows a preferred variant of a carrier element 1 with three receptacles 4 in which the connection elements 3 can be fastened following a linear path of motion. Here, in the area of each receptacle 4, the carrier element 1 has a retaining lip 23 forming the second receptacle section 4*b*.

This retaining lip 23, constructed in the present embodiment essentially in the form of an open half shell, is elevated relative to the top side 17 of the carrier element 1 pointing toward the housing 2. The retaining lip 23 is constructed in the present embodiment integrally with the carrier element 1, wherein the increase of the retaining lip 23 above the top side 17 of the carrier element 1 is produced, e.g., by a deep-drawing process.

Figure 9:
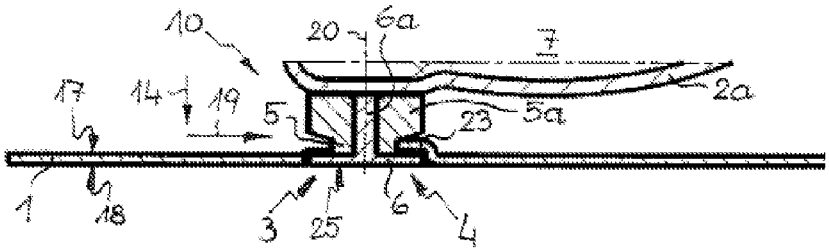
Figure 10:
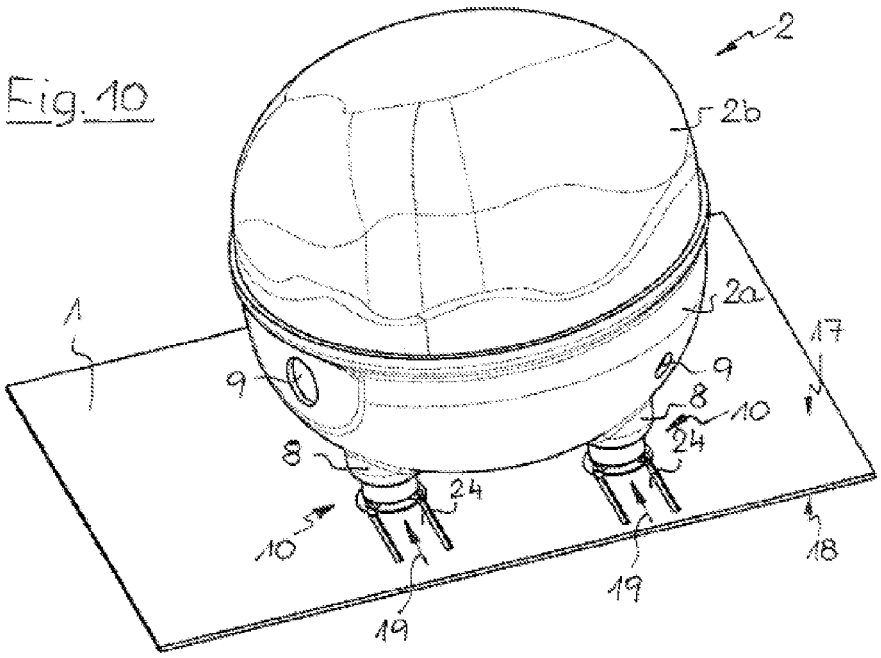
FIG. 10 a perspective view of a refrigerant-compressor housing fastened according to the invention on a carrier element according to FIG. 7
Figure 11:
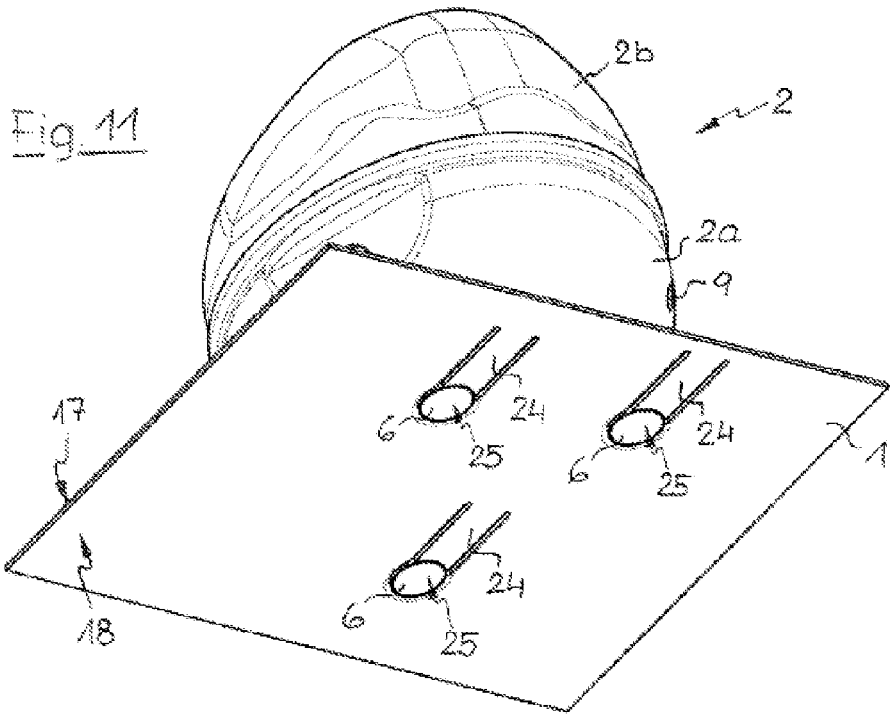
FIG. 11 the refrigerant-compressor housing fastened on the carrier element from FIG. 10 in a bottom view FIG. 12 a detail view of a receptacle spring section according to the viewing direction B in FIG. 7

The representation according to FIG. 7 is more easily understood when a sectional diagram shown in FIG. 9 is considered. FIG. 9 shows a vertical section running through the connection device 10 according to the invention according to the section guide A-A in FIG. 8, wherein the connection element 3 is already located in its fastened end position in the receptacle 4.

The foot section 6 of the connection element 3 can slide with an end face 25 facing away from the housing 2 on the top side 17 of the carrier element 1 and is initially positioned (together with the housing 2) in the area of the first receptacle section 4*a* shown in FIG. 7. This positioning can be performed in the course of a first mounting movement of the connection element 3 performed in a first mounting direction 14. In contrast to the receptacles 4 described with reference to FIG. 2, the receptacles 4 according to FIG. 7 have an open construction or do not have closed peripheral contours. Indeed, the second receptacle section 4*b* constructed by the retaining lip 23 is constructed, in turn, in the embodiment according to FIG. 7 as a borehole, but this borehole or the second receptacle section 4*b* is open.

On the retaining lip 23 there are two end sections 23*a*, 23*b* that point in the direction of the first receptacle section 4*a* and are initially contacted and then passed by the shaft section 5 of the connection element 3 moved along the linear, second mounting direction 19 in the course of a second mounting movement, before the shaft section 5 or the connection element 3 is moved into its end position in the second receptacle section 4*b*.

The foot section 6 of the connection element 3 slides on the top side 17 of the carrier element 1 with an end face 25 facing away from the housing during the entire second mounting movement along the second mounting direction 19.

Stated precisely, the first receptacle section 4*a* of the receptacle 4 is defined in this variant only by the two end faces 23*a*, 23*b* of the retaining lip 23, while the first receptacle section 4*a* is otherwise open. At this point it should be noted that, obviously, also for the embodiment according to FIGS. 1-6, an open receptacle 4 could be provided or this does not necessarily have to have peripheral contours closed on all sides.

The dimensioning possibilities already described with reference to FIGS. 1-6 for the receptacle 4 and the connection element 3, especially the dimensioning of the widths 4*b*', 4*c*' and 5' of the receptacle 4 or the shaft section 5 shown in FIG. 7 can also be applied in the embodiment according to FIGS. 7-11.

For the embodiment according to FIGS. 7-11, the third receptacle section 4*c* that makes latching possible is produced in each area of the receptacle 4 in which the end faces 23*a*, 23*b* of the retaining lip 23 open into the second receptacle section 4*b* (see FIG. 7), while the diameter of the borehole forming the second receptacle section 4*b* is measured, in turn, as the open width of the second receptacle section 4*b*.

In order to securely fasten the foot section 6 of the connection element 3 and thus the housing 2 on the carrier element 1, the carrier element is also provided with a spring section 24 (see the top view according to FIG. 7). During a movement of the connection element foot section 6 into the retaining lip 23, the spring section 24 can be displaced from an unloaded position into a retained position in which the connection element 3 is fastened in the receptacle 4.

Figure 12:
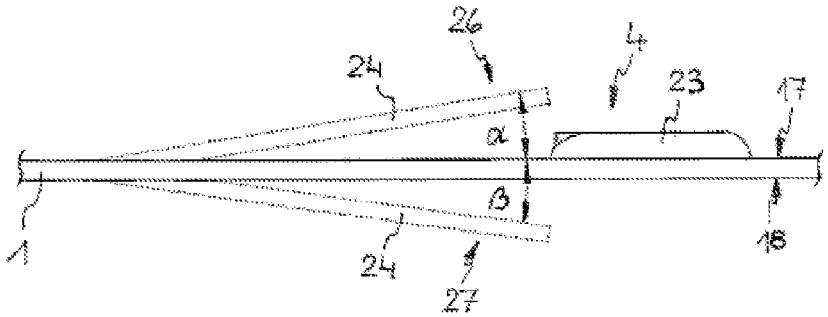

Advantageously, this spring section 24 raises into an unloaded position 26, as shown in a side view according to FIG. 12, above the top side 17 of the carrier element 1 and can be displaced during the fastening of the housing 2 on the carrier element 1 in the mounting direction 19, due to the engagement of the connection element foot section 6 in the retaining lip 23, into a tensioned position 27 (the tensioned position 27 corresponds in this case to the retained position of the spring section 24). If the connection element foot section 6 was moved into the retaining lip 23, then the end face 25 of the connection element foot section 6 is contacted in some sections by an end section of the spring section 24 pointing toward the receptacle 4 under tension and the connection element foot section 6 is clamped tightly between the retaining lip 23 and the spring section 24. This has the result that the connection element 3 is fastened in its end position in the receptacle 4 and thus the housing 2 is fastened in its operating position on the carrier element 1.

In the unloaded state 26, the spring section 24 can raise by a first angle $\alpha$ of up to 45° relative to the top side 17 of the carrier element 1, while the spring section 24 can bend in its retained position or in the tensioned position 27 by a second angle $\beta$ of up to 45° relative to the top side 17 in a direction facing away from the housing 2 (FIG. 12). The second angle $\beta$ can also equal approximately zero, so that the spring section 24 is located essentially in a plane with the carrier element in its tensioned position 27.

In one preferred variant, the spring section 24 is constructed in the form of a web constructed integrally with the carrier element 1. This web can be bent in the direction of the housing 2 for fastening on the carrier element 1 (as shown in FIG. 12—unloaded state 26). Obviously, the spring section 24 could also involve a separate component that can be attached on the carrier element 1.

As an alternative to a clamped contact of the end face 25 of the connection element foot section 6 by the spring section 24 located in its retained position, it is also possible that the foot section 6 comes to lie in its retained position next to the foot section 6 or next to the shaft section 5, wherein advantageously a peripheral area of the foot section 6 or the shaft section 5 of the connection element 3 is contacted by an end section of the spring section 24 (as shown in FIG. 9). Also here, the spring section 24, before it comes into its retained position, is initially displaced by the foot section 6 of the connection element 3 from an unloaded position—in which the spring section 24 is located above or under, but advantageously at the same height as the carrier element 1 (in the latter case, the angles $\alpha$ and $\beta$ thus equal approximately zero)—into a tensioned position 27 (FIG. 12). However, after the completed movement of the connection element 3 into its end position from the tensioned position 27, the spring section 24 snaps back, due to its elasticity, into a retained position in which the spring section 24 is again located above or under, but advantageously at the same height as the carrier element 1 (in the latter case, the angles $\alpha$ and $\beta$ again equal approximately zero).

It is understood that the retaining lip 23 overlaps the foot section 6 of the connection element 3 so far that a reliable hold of the connection element 3 in the receptacle 4 is guaranteed.

Instead of a latched fastening of the connection elements 3 in the receptacles 4 described with reference to the present figures, a clamped fastening of the connection elements 3 in the receptacles 4 is also possible, in that the receptacles 4 are tapered in a linear manner, e.g., along the second mounting direction 19, and the shaft sections 5 of the connection elements 3 are fastened successively in the receptacle 4 or in the second receptacle section 4*b* during movement from their starting position into their end position.

The invention claimed is:

1. A device for fastening the housing (2) of a refrigerant compressor on a container enclosing a cooling volume, comprising:

the housing (2) fastened by an arbitrary number of connection elements (3) on a carrier element (1) arranged on the container and at least one connection element (3) is provided that can be fastened in a clamping or latching manner in at least one corresponding receptacle (4), wherein the at least one connection element (3) and the at least one receptacle (4) can be arranged on the housing (2) and the carrier element (1) respectively, and wherein the housing (2) can be moved from a first mounting position in which the at least one connection element (3) is threaded into the at least one receptacle (4) to an operating position in which the connection element (3) is fastened in a clamping or latching manner in the receptacle (4), wherein the receptacle (4) has a first receptacle section (4*a*) in which the connection element (3) can be threaded into the receptacle (4) and a second receptacle section (4*b*) in which the connection element (3) is latched or clamped, and the carrier element (1) has a retaining lip (23) that forms the second receptacle section (4*b*) and is elevated relative to a top side (17) of the carrier element (1) pointing toward the housing (2), wherein a foot section (6) of the connection element (3) can slide with an end (25) facing away from the housing (2) on the top side (17) of the carrier element (1) and can be moved into the retaining lip (23);

further comprising that the connection element (3) has a shaft section (5) that can be held in the receptacle sections (4*a*, 4*b*) of the receptacle (4) and the foot section (6) is adjacent to the shaft section, wherein the open width (4*a*') of the first receptacle section (4*a*) is greater than the greatest cross-sectional width (6') of the foot section (6), while the open width (4*b*') of the second receptacle section (4*b*) is less than the greatest cross-sectional width (6') of the foot section (6);

further comprising that at least the shaft section (5) of the connection element (3) is produced from a material that can be deformed elastically or plastically.

2. A device for fastening the housing (2) of a refrigerant compressor on a container enclosing a cooling volume, comprising:

the housing (2) fastened by an arbitrary number of connection elements (3) on a carrier element (1) arranged on the container and at least one connection element (3) is provided that can be fastened in a clamping or latching manner in at least one corresponding receptacle (4), wherein the at least one connection element (3) and the at least one receptacle (4) can be arranged on the housing (2) and the carrier element (1) respectively, and wherein the housing (2) can be moved from a first mounting position in which the at least one connection element (3) is threaded into the at least one receptacle (4) to an operating position in which the connection element (3) is fastened in a clamping or latching manner in the receptacle (4), wherein the receptacle (4) has a first receptacle section (4*a*) in which the connection element (3) can be threaded into the receptacle (4) and a second receptacle section (4*b*) in which the connection element (3) is latched or clamped, and the carrier element (1) has a retaining lip (23) that forms the second receptacle section (4*b*) and is elevated relative to a top side (17) of the carrier element (1) pointing toward the housing (2), wherein a foot section (6) of the connection element (3) can slide with an end (25) facing away from the housing (2) on the top side (17) of the carrier element (1) and can be moved into the retaining lip (23);

further comprising that the connection element (3) has a shaft section (5) that can be held in the receptacle sections (4*a*, 4*b*) of the receptacle (4) and the foot section (6) is adjacent to the shaft section, wherein the open width (4*a*') of the first receptacle section (4*a*) is greater than the greatest cross-sectional width (6') of the foot section (6), while the open width (4*b*') of the second receptacle section (4*b*) is less than the greatest cross-sectional width (6') of the foot section (6);

further comprising that the shaft section (5) and the foot section (6) of the connection element (3) are made as separate components, wherein the shaft section (5) has a passage opening (13) through which an advantageously bolt-shaped adapter section (6*a*) of the foot section (6) is guided, wherein this adapter section can be fastened on the housing (2).

3. A device for fastening the housing (2) of a refrigerant compressor on a container enclosing a cooling volume, comprising:

the housing (2) fastened by an arbitrary number of connection elements (3) on a carrier element (1) arranged on the container and at least one connection element (3) is provided that can be fastened in a clamping or latching manner in at least one corresponding receptacle (4), wherein the at least one connection element (3) and the at least one receptacle (4) can be arranged on the housing (2) and the carrier element (1) respectively, and wherein the housing (2) can be moved from a first mounting position in which the at least one connection element (3) is threaded into the at least one receptacle (4) to an operating position in which the connection element (3) is fastened in a clamping or latching manner in the receptacle (4), wherein the receptacle (4) has a first receptacle section (4*a*) in which the connection element (3) can be threaded into the receptacle (4) and a second receptacle section (4*b*) in which the connection element (3) is latched or clamped, and the carrier element (1) has a retaining lip (23) that forms the second receptacle section (4*b*) and is elevated relative to a top side (17) of the carrier element (1) pointing toward the housing (2), wherein a foot section (6) of the connection element (3) can slide with an end (25) facing away from the housing (2) on the top side (17) of the carrier element (1) and can be moved into the retaining lip (23);

further comprising that the connection element (3) can be fastened in the receptacle (4) along a linear path;

further comprising that the carrier element (1) has a spring section (24) that can be displaced during a transfer of the connection element foot section (6) into the retaining lip (23) from an unloaded position (26) into a retained position in which the connection element (3) is fastened in the receptacle (4).

4. The device according to claim 3, further comprising that, in its unloaded position (26), the spring section (24) is raised above the top side (17) of the carrier element (1) and, in its retained position, contacts the end face (25) of the connection element foot section (6) at least in some sections.

5. The device according to claim 3, further comprising that the spring section (24) is constructed in the form of a web that is constructed integrally with the carrier element (1) and that is advantageously bent in the direction of the housing (2) to be fastened on the carrier element (1).

* * * * *